US005833142A

United States Patent [19]

Caley

[11] Patent Number: 5,833,142

[45] **Date of Patent: *Nov. 10, 1998**

[54] FUEL INJECTOR NOZZLES

[75] Inventor: David James Caley, Sorrento, Australia

[73] Assignee: Orbital Engine Company (Australia) Pty. Limited, Palcatta, Australia

[ * ] Notice: The term of this patent shall not extend beyond the expiration date of Pat. No. 5,551,638.

[21] Appl. No.: 592,316

[22] PCT Filed: Aug. 17, 1994

[86] PCT No.: PCT/AU94/00483

§ 371 Date: Feb. 16, 1996

§ 102(e) Date: Feb. 16, 1996

[87] PCT Pub. No.: WO95/05537

PCT Pub. Date: Feb. 23, 1995

[30] Foreign Application Priority Data

| | | | |
|---|---|---|---|
| Aug. 18, 1994 | [AU] | Australia | PM0648 |
| Aug. 31, 1994 | [AU] | Australia | PM0935 |

[51] Int. Cl.[6] ..... B05B 1/32

[52] U.S. Cl. ..... 239/453; 239/507; 239/533.12; 239/584

[58] Field of Search ..... 239/451–453, 239/507, 533.3, 533.7, 533.12, 584, 585.5

[56] References Cited

U.S. PATENT DOCUMENTS

| | | | |
|---|---|---|---|
| 418,144 | 1/1889 | Landen | 239/453 |
| 1,755,192 | 4/1930 | Scott | 239/533.12 |
| 3,069,099 | 12/1962 | Graham | 239/453 |
| 3,118,611 | 1/1964 | Berlyn | 239/533.7 |
| 4,082,224 | 4/1978 | Mangus | 239/453 |
| 4,270,257 | 6/1981 | Kimata et al. | 239/453 |
| 4,394,970 | 7/1983 | Hefmann et al. | 239/453 |
| 4,473,189 | 9/1984 | Itoh et al. | 239/453 |
| 4,497,443 | 2/1985 | Suaer | 239/533.3 |
| 4,662,338 | 5/1987 | Itoh et al. | 239/453 |
| 4,932,591 | 6/1990 | Cruz | 239/498 |
| 4,934,329 | 6/1990 | Lear et al. | 123/531 |
| 4,982,708 | 1/1991 | Stutzenberger | 239/453 |
| 5,090,625 | 2/1992 | Davis | 239/453 |
| 5,405,088 | 4/1995 | Gordon et al. | 239/453 |
| 5,551,638 | 9/1996 | Caley | 239/453 |
| 5,593,095 | 1/1997 | Davis et al. | 239/533.12 |

FOREIGN PATENT DOCUMENTS

| | | |
|---|---|---|
| 981.581 | 5/1951 | France . |
| 31 05 687 | 9/1982 | Germany . |
| 373591 | 7/1932 | United Kingdom . |
| 394048 | 7/1933 | United Kingdom . |

OTHER PUBLICATIONS

Patent Abstracts of Japan, M–575, pp. 71, JP, A, 61–247862.
Patent Abstracts of Japan, M–566, pp. 32, JP, A, 61–223266.
International Publication No. WO/93/16282 published Aug. 19, 1993.

*Primary Examiner*—Andres Kashnikow
*Assistant Examiner*—Lisa Ann Douglas
*Attorney, Agent, or Firm*—Nikaido, Marmelstein, Murray & Oram LLP

[57] ABSTRACT

An injector nozzle has a body having a nozzle through which fuel is delivered. The nozzle includes a port having an internal surface and a valve member having a complementary external surface. The valve member is movable relative to the port to respectively provide a passage between the surfaces for delivery of fuel in the form of a spray or sealed contact therebetween to prevent the delivery of fluid. A fluid flow control body is located beyond an extremity of the nozzle body corresponding to the location of the port. The control body has a control surface configured and positioned such that the fuel spray established by fluid issuing from the port will follow a path determined at least in part by that control surface. The flow control body is in part hollow.

10 Claims, 4 Drawing Sheets

FUEL INJECTOR NOZZLES

This invention relates to a valve controlled nozzle for the injection of fluid, such as a valve controlled nozzle for the injection of fuel in an internal combustion engine. In this specification, the term "internal combustion engine" is to be understood to include engines having an intermittent combustion cycle such as reciprocating or rotary engines operating on either the two or four stroke cycle.

The characteristics of the fuel spray delivered from an injector nozzle to an internal combustion engine, such as directly into the combustion chamber, have a major effect on the control of the combustion of the fuel, which in turn affects the stability of the operation of the engine, the engine fuel efficiency and the composition of the engine exhaust gases. To optimise these effects, particularly in a spark ignited engine, the desirable characteristics of the fuel spray issuing from the injector nozzle include small fuel droplet size (liquid fuels), controlled spray geometry and in the case of direct injected engines, controlled penetration of the fuel into the combustion chamber. Further, at least at low fuelling rates, a relatively contained and evenly distributed ignitable cloud of fuel vapour in the vicinity of the engine spark plug is desirable.

Some known injector nozzles, used for the delivery of fuel directly into the combustion chamber of an engine, are of the outwardly opening poppet valve type, which deliver the fuel in the form of a cylindrical or divergent conical spray. The nature of the shape of the fuel spray is dependent on a number of factors including the geometry of the port and valve constituting the nozzle, especially the surfaces of the port and valve immediately adjacent the valve seat, where the port and valve engage to seal when the nozzle is closed. Once a nozzle geometry has been selected to give the required performance of the injector nozzle and hence the combustion process, it is important to maintain such geometry otherwise the performance of the engine can be impaired, particularly at low fuelling rates.

The attachment or build-up of solid combustion products or other deposits on the nozzle surfaces over which fuel flows can affect the geometry of the fuel flow path through the open nozzle and can therefore affect the creation of the correct fuel distribution, and hence the combustion process of the engine. The principal cause of build-up on these surfaces is the adhesion thereto of carbon particles or other particles that arise from the combustion of the fuel, including incomplete combustion of residual fuel left on these surfaces between injection cycles. Methods of reducing or controlling such build-up are known as disclosed in the applicant's Australian Patent Application Nos. 36205/89 and 71474/91.

It is known that a hollow spray or fuel plume issuing from a nozzle initially follows a path principally determined by the exit direction and exit velocity of the fuel. It is also known that as the fuel spray advances beyond the delivery end of the injector nozzle, a pressure is created within the area bound by the spray immediately downstream of the nozzle that is lower than the pressure on the outside of fuel spray and which promotes an inward contraction of the spray. This is referred to as "necking".

It has been found that disturbances to the fuel flow issuing from an injector nozzle can significantly influence the shape of the fuel spray or plume, particularly during and subsequent to the necking thereof. Such influences can promote unpredictable deflection and/or dispersion of the fuel, which in turn can adversely affect the combustion process and thus may give rise to an increase in fuel consumption, undesirable levels of exhaust emissions, and also instability in engine operation, particularly during low load operation.

Disturbances that can give rise to such undesirable influences include the presence of irregular deposits on the surfaces defining the injector nozzle exit, such as carbon and other combustion related deposits, eccentricity of the valve and seat components of the nozzle, and or excessive clearance between the stem supporting the valve and the bore in which the valve stem axially moves as the valve opens and closes the injector nozzle exit. Lateral movement or eccentricity of the valve, and deposits on the surfaces of the valve or valve seat can each result in changes in the relative rate of flow through different sections of the periphery of the nozzle, thus causing an asymmetric fuel spray.

The above discussed disturbances to the delivery of fuel, such as to the combustion chamber of an engine, are particularly significant in engines operating with a highly stratified air/fuel mixture, such as is recognised as highly desirable to control exhaust emissions during low load operation.

The applicant's U.S. Pat. No. 5,551,638 provides an injector nozzle with a projection dependent from the valve head thereof and having an external toroidal surface. However, a projection having such geometry has been found by the applicant to be only one of a number of different geometries which it has developed and found suitable in the control of the shape and direction of the fuel spray or plume issuing from an injector nozzle. Furthermore, the applicant has found that the projections as disclosed in the aforesaid co-pending patent application may be improved from the point of view of heat transfer and mechanical performance so that the projections have a greater heat retention and capacity to combust, or otherwise remove, carbon deposits therefrom. The applicant has also discovered in their research different arrangements for the support of the projection which are advantageous from the point of view of the control of the shape and direction of the fuel spray issuing from an injector nozzle.

The present invention therefore provides, in its broadest form, an injector nozzle comprising a body having a nozzle through which fluid is delivered, said nozzle comprising a port having an internal surface and a valve member having a complementary external surface, said valve member being movable relative to the port to respectively provide a passage between said surfaces for the delivery of fluid in the form of a spray or sealed contact therebetween to prevent the delivery of fluid, characterised by the provision of a fluid flow control body located beyond an extremity of the body of the injector nozzle corresponding to the location of the port, said flow control body having a control surface spaced from the nozzle in the direction of movement of the valve member, said control surface being configured and positioned to promote the fluid spray established by the fluid issuing from the port to follow a path determined by the shape of said control surface.

Preferably the flow control body is configured and positioned to promote the fuel spray to contract inwardly to follow the path determined by the shape of the control surface.

Conveniently, the flow control body may be mounted to either the valve member or the body of the injector nozzle to extend beyond the extremity thereof in a direction generally corresponding to the direction that the fluid spray issues from the port. However, such location or mounting is not essential and any advantageous location or mounting may be employed.

The present invention may be advantageously applied to a fuel injector nozzle as used in an internal combustion engine, and particularly, a fuel injector nozzle delivering fuel directly into the combustion chamber of the engine, and particularly where the fuel is entrained in a gas such as air. Accordingly, the flow control body may be advantageously located at specific locations within the engine combustion chamber. Where it is desired to guide the fuel spray in a particular direction within the combustion chamber of an internal combustion engine, for example, towards an igniting means such as a spark plug, it may be desirable to mount the flow control body elsewhere than on the valve member. Hence, the flow control body is not necessarily a projection or portion provided at one end of the valve member. For instance, the flow control body may be dependant from the cylinder head, cylinder wall, spark plug or any other appropriate surface.

The control surface of the flow control body may typically be an external surface and the flow control body may be hollow, but for other applications, an internal control surface may be more appropriate.

Conveniently, in the case of a flow control body connected to the valve member or the body of the injector nozzle, the flow control body may be configured to be at least partly hollow so as to provide greater heat retention properties due to a reduced conductive flow path through which heat can pass to the valve member and/or nozzle. Thus, high temperatures are more effectively maintained in the flow control body and hence, problems arising from carbon deposition on the surfaces of the nozzle and/or valve member are likely to be less significant. Further, in the case of a flow control body connected to a moving valve element, the reduced weight results in a more responsive valve mechanism. Still further, the hollow construction employed in the configuration of the flow control body may extend into the valve member itself, thus reducing the impact momentum upon opening and closing movement of the valve member. In particular, where the flow control body includes a necked portion dependent from the valve head, the hollow portion would also serve to create a restricted heat conduction path to the valve member and hence the nozzle.

The flow control body may be of a wide variety of geometric shapes both in cross-section and lengthwise, including assymetric cross-sections or a cross-section of constant geometry but varying cross-sectional area. Further, the flow control body may be provided with internal or external grooves that may assist in the shaping of a desired spray geometry. Such grooves, may also provide an increased surface area of the flow control body which may be useful in achieving greater heating of the flow control body. Further, the flow control body does not necessarily have to be axially aligned with the valve member or the direction of movement thereof, nor does it have to be symmetric about a particular axis.

Further, the flow control body may be provided with a portion which is movable in relation to the remainder thereof. For example, a movable portion can be attached to a flow control body that is connected to the valve member. The movable portion can take the form of a collar movably mounted upon a spigot fixed to the valve member, the collar being movable in response to the movement of the valve member. The movement of the movable portion may be constrained by the provision of impact faces with which the movable portion collides causing vibration of the flow control body to promote dislodgement of any carbon deposits thereon. Preferably, the surface that functions to guide the fluid spray is provided either entirely or partly on the movable portion.

In each of these proposals, the flow control body is preferably configured and positioned such that the fluid spray, issuing from the nozzle when open will embrace a portion of the control surface of the flow control body adjacent the valve member and subsequently flow along a path at least partly determined by the shape or form of the flow control surface. Furthermore, the flow control body can be employed in valves of the poppet or pintle type and can be attached to the valve member of either of such valve types.

Conveniently, the spacing of the flow control body when it extends from the valve member, can be achieved by providing a necked portion between the valve member and the adjacent end of the flow control body which reduces the cross-sectional area through which heat can flow from the flow control body into the valve member and hence be dissipated through the injector nozzle to the engine cylinder or cylinder head. This necking contributes to retaining heat in the flow control body to thereby maintain the control body at a sufficiently high temperature to burn off any carbon or other particles that develop or are deposited on the surface thereof. Equally, where the flow control body depends from the body of the injector nozzle or another part of the combustion chamber rather than the valve member, a necked or narrow portion can be provided to achieve the heat retention effect described above.

The use of the flow control body to aid in the control of the configuration and path of the fluid spray, created as fluid issues from the injector nozzle, significantly contributes to better management of the combustion process and hence, better control of exhaust emissions and engine fuel efficiency. The flow control body stabilises the fluid spray by providing a physical surface to guide the spray downstream of the nozzle. This has the result of reducing lateral deflection of the fluid during the injection period.

The engagement of the fluid spray with the control surface of the flow control body arises in the main from the natural inward necking of the spray a short distance after the spray issues from the injector nozzle partly due to a phenomenen known as the Coanda effect. Once such engagement has been established, the spray will maintain proximity with, and be guided by, the control surface of the flow control body. The spray will thus follow a path generally corresponding with the adjacent surface of the flow control body thereby reducing the possibility of lateral displacement and/or disturbance of the fluid spray.

It is to be appreciated that the guidance of the fluid spray, by the control surface of the flow control body will promote uniformity in the direction of flow of the fluid spray into the engine combustion chamber, countering other influences as previously discussed that could cause irregularities or diversion of the fluid spray or portions thereof. The guidance of the fluid spray can also aid in the correction of differences in or disturbances to the spray arising from manufacturing variations including tolerance variations from engine to engine.

The invention will be more readily understood from the following description of several practical but exemplary arrangements of the fuel injector nozzle as depicted in the accompanying drawings.

The fuel injector nozzles and valves as depicted in FIGS. 1 to 7 and hereinafter described, can be incorporated into a wide range of fuel injectors used for the delivery of fuel into the combustion chamber of an engine. Typical forms of injectors in which the nozzle as hereinbefore described can be incorporated are disclosed in the applicant's U.S. Pat. No. 4,934,329 and in U.S. Pat. No. 4,844,339 and the disclosure of each of these prior documents is hereby incorporated in this specification by reference.

Figure 1:
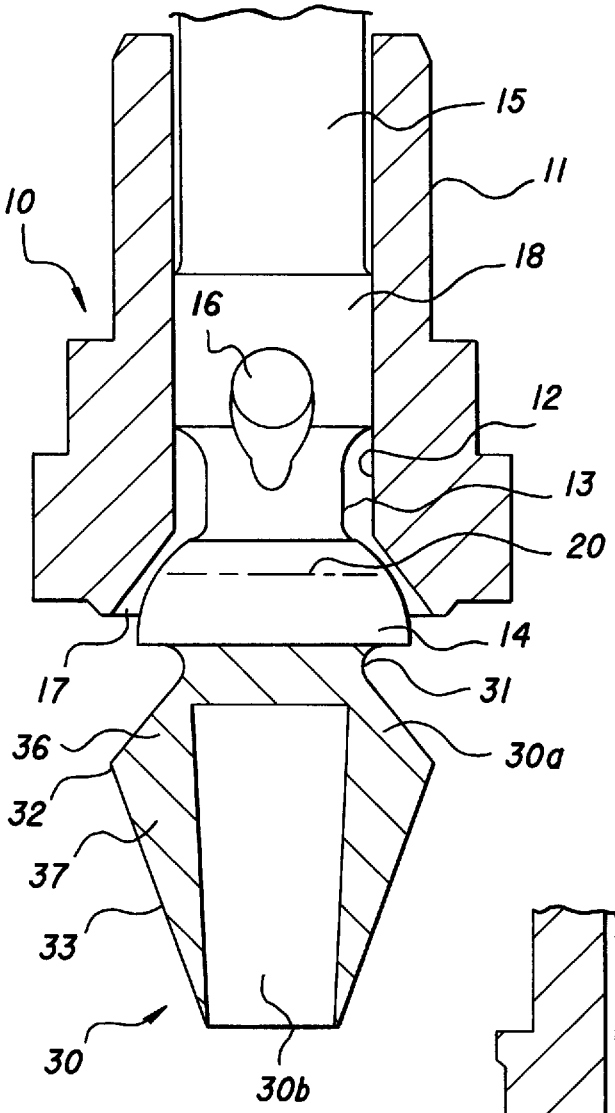
FIG. 1 is a part-sectional view of a fuel injector valve having dependent therefrom a flow control body according to a first embodiment of the present invention.

Referring now to FIG. 1 of the drawings, the body 10 of the fuel injector nozzle is of a generally cylindrical shape having a spigot portion 11 which is arranged to be received in a bore provided in a co-operating portion of a complete fuel injector unit. A valve member 13 arranged to co-operate with the nozzle body 10 has a valve head 14 and a valve stem 15. The stem 15 has a guide portion 18 which is axially slidable in a bore 12 of the body 10. The stem 15 is hollow so that the fuel can be delivered therethrough, and openings 16 are provided in the wall of the stem 15 to permit the fuel to pass from the interior of the stem 15 into the bore 12.

The valve head 14 is of a part-spherical form and is received in a port 17 provided in an end of the body 10 which communicates with the bore 12. The wall of the port 17 is of a frustro-conical form and engages the valve head 14 along the seat line 20 when the valve 13 is in the closed position. A flow control body 30 is formed integral with the head 14 of the valve 13 and is connected thereto by a neck portion 31, which is of a substantially reduced cross-sectional area compared to the majority of the flow control body 30 so as to restrict heat flow from the flow control body 30 into the valve 13 and injector body and thereby raise the temperature of the flow control body 30 as previously referred to herein.

The flow control body 30 is comprised of two portions, 36 and 37 both of a truncated conical shape with the shorter portion 36 adjoining the neck portion 31. In order to further restrict the heat flow from the flow control body 30 to the nozzle, a cylindrical cavity 30*b* is formed within the guide projection 30. Accordingly, the remaining wall thickness or heat transfer area of the flow control body 30 is significantly less than would be available if the flow control body 30 were of a solid construction. Thus there is created a restriction to heat transfer to the injector nozzle in the vicinity of 30*a* and improved heat retention in the flow control body 30.

It is to be noted that the cavity 30*b* need not be cylindrical as any geometry of the cavity 30*b* which reduces the heat conduction path may be employed. As an additional benefit, the provision of cavity 30*b* will reduce the momentum and hence impact speed of the valve member 13 on closing thus improving injection control and noise reduction characteristics.

The diameter of the junction 32 between the two portions 36 and 37 of the flow control body 30 is selected so that the fuel spray issuing from the port 17 when open, will follow a path based on an external surface 33 of the flow control body 30. The diameter of the junction 32 to promote attachment of the inner boundary layer of the issuing fuel spray to the external surface 33 of the low control body 30 so that the fuel spray will follow a path complementary to surface 33 is largely determined experimentally. The configuration of the external surface 33 may be selected to specifically direct the fuel in a desired direction not co-axial with the injector nozzle.

If the configuration of the port 17 and valve head 14 provide a fuel spray that diverges outwardly from the nozzle end face, it may be desirable to have the diameter of the flow control body 30 at the junction 32 thereof larger than the diameter of the valve head 14. However, the diameter at the junction 32 must not be such to extend into or through the fuel spray issuing from the nozzle, as this would result in a breaking up and/or an outward deflection of the fuel spray contrary to the aim of the invention. Further, the diameter of the fuel control body 30 adjacent the nozzle may be less than that of the valve head 14, as an issuing fuel spray naturally collapses inwardly after leaving the nozzle, as previously referred to, and would be thus brought into contact with the external surface 33 of the flow control body 30. Further, the axial spacing between the end face of the valve head 14 and the commencement of the external surface 33 at the junction 32 of the flow control body 30 is selected to promote the attachment of the issuing spray to the external surface 33.

It will be appreciated by those skilled in the art that the dimensions of the flow control body 30 are influenced by a number of factors including the dimensions of the injector nozzle, the nature of the fluid or fuel to be injected and the velocity and direction of delivery from the nozzle. Typical dimensions of the flow control body 30 as shown in FIG. 1 are provided below by way of example only:

| | |
|---|---|
| Diameter of the Sphere Defining the Convex Valve Surface | 5.5 mm |
| Valve Seat Included Angle | 80° |
| Flow Control Body End Diameter | 2.5 mm |
| Flow Control Body Lower Included Angle | 40° |
| Flow Control Body Upper Included Angle | 85° |
| Flow Control Body Length | 8.2 mm |

Figure 2:
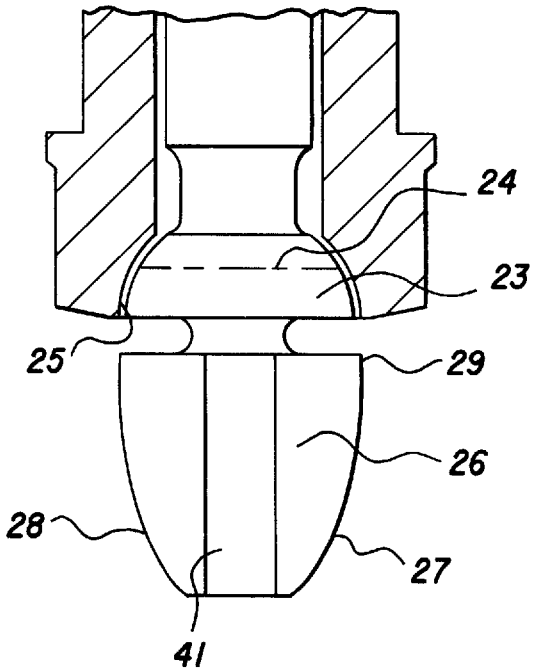
FIG. 2 is a part-sectional view similar to FIG. 1 of another form of the flow control body.

There is shown in FIG. 2 an alternative form of injector nozzle and flow control body wherein a guide surface 27 of the flow control body 26 is not of a truncated conical form, but is of a tapered form curved in the longitudinal direction. Initially the surface 27 is of a non-convergent form in an upper portion 29 and smoothly translates to a convergent form in a lower portion 28 remote from a valve head 23.

It is to be noted that as the surface of the valve head 23 and the surface of a co-operating port 25 are substantially co-axial and terminate at the delivery end of the nozzle substantially at a common diametric plane, the fuel spray or plume issuing therefrom will initially contact the diverging portion 29 of the surface 27 and will subsequently follow a path determined by the converging portion 28 of the surface 27 towards the lower end of the flow control body 26. In addition, a plurality of arcuate shaped longitudinal grooves 41 may be provided on the projection 26 as hereinbefore described. Any desired number or geometry of grooves 41 may be provided.

Figure 3:
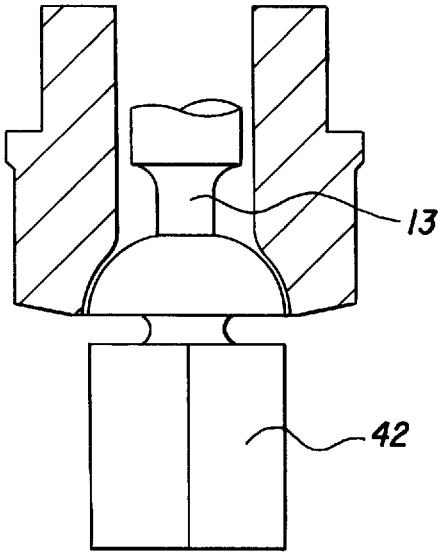
FIG. 3 is a part-sectional view of a fuel injector valve having a further alternative form of flow control body dependent therefrom.
Figure 4:
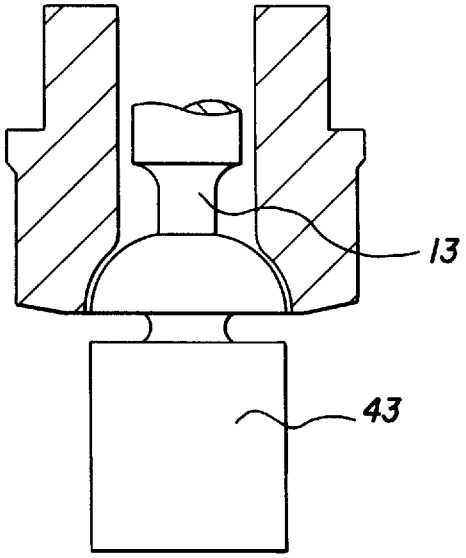
FIG. 4 is a part-sectional view similar to FIG. 3 of another form of the flow control body.

As shown in FIGS. 3 and 4, triangular and rectangular prismatic shaped flow control bodies 42 or 43, respectively, may be provided dependent from the valve member 13 of the nozzle. It will be noted that the flow control bodies 42, 43 have a constant prismatic surface in the axial direction of the valve 13. Further, the geometry of the flow control bodies 42, 43 is shown in FIGS. 3 and 4 respectively as being symmetrical about the axis of the valve 13, but it is not essential that they be symmetrical or axially aligned.

Figure 5:
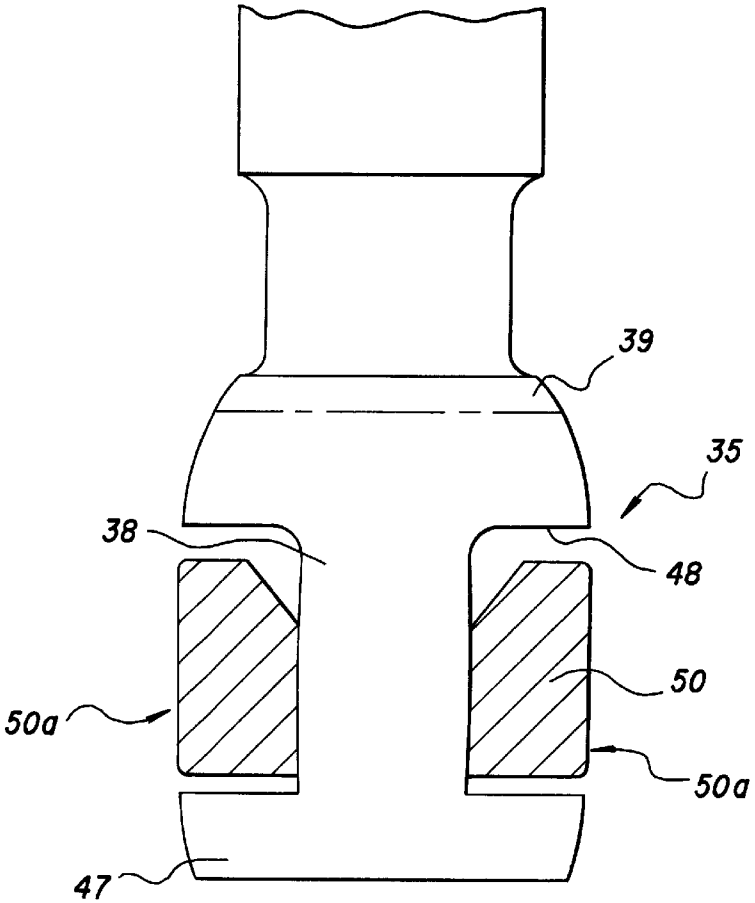
FIG. 5 is a part-sectional view of a fuel injector valve having dependent therefrom a multi-part flow control body.

Referring now to FIG. 5, there is shown a construction in which a flow control body 35 is in the form of a spigot 38 projecting centrally from an end face 48 of a valve head 39 in the downstream direction, terminating in a flange portion 47, and having a movable toroidal collar 50 located on the spigot 38 between the valve head 39 and the flange portion 47. The external surface 50*a* of the collar 50 provides the flow control surface to which the fuel spray or plume will attach to and be guided on a prescribed path as previously discussed.

The collar 50 has a substantial degree of freedom to move in the axial direction of the spigot 38, and will so move in response to the movements of the valve head 39 to open and close a co-operating port of the injector nozzle. When this movement occurs, impact of the collar 50 will either occur at flange 47 or end face 48 of the valve head 39. The impact of the collar 50 causes vibration of the entire flow control body 35 which is sufficient to promote dislodgment of carbon deposits thereon.

As modifications to the embodiment of FIG. 5, there may be provided a hollow form of spigot 38 and/or flange 47 to maximise heat retention in the flow control body 35. Also, movable components of different geometry to that of the toroidal collar 50 may be used. In addition, the collar 50, spigot 38 and flange 47 may be constructed of materials of different thermal conductivity or density in order to change the heat retention or vibrational characteristics of the flow control body 35.

In regard to each of the embodiments described hereinbefore, the flow control body can be constructed of a low heat transfer material, particularly a material having a lower heat transfer rate than the stainless steel normally used for the valve of a fuel injector nozzle.

Figure 6:
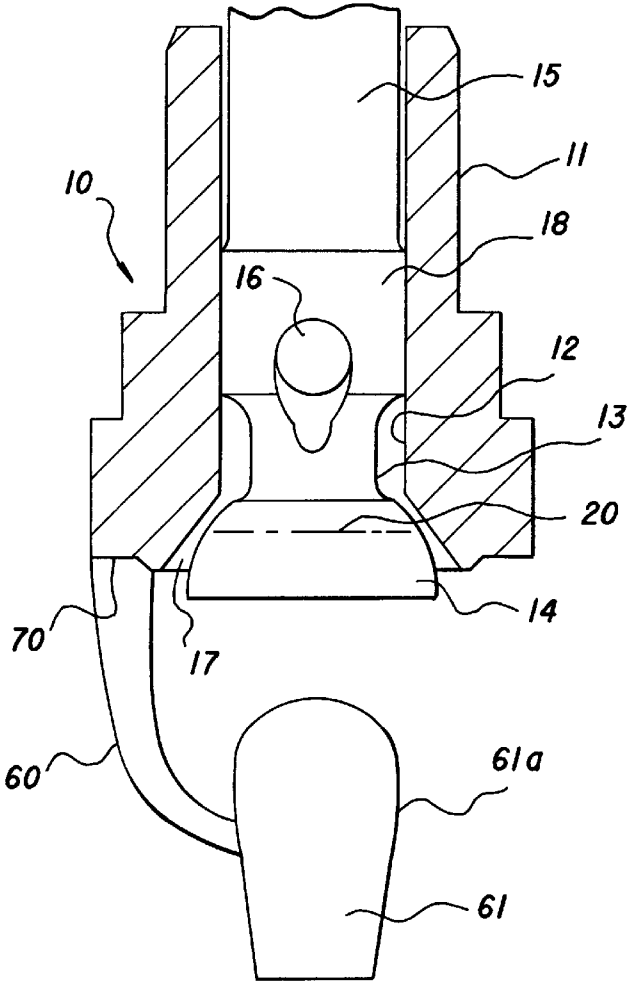
FIG. 6 is a part-sectional view of a fuel injection nozzle having a flow control body supported from the injector body thereof.

FIG. 6 shows a construction in which a flow control body 61 is arranged at the downstream extremity of an arm 60 extending from an end face 70 of the spigot portion 11 as previously described in FIG. 1. The arm 60 is designed such as not to occlude the issue of fuel from the port 17, but such as to ensure that the fuel spray issuing from the nozzle when open will follow a path based on the external surface 61*a* of the flow control body 61. If desired, the arm 60 may be constructed of a higher thermal conductivity material than that of the spigot portion 11 such that heat transfer to the flow control body 61 and heat retention therein is promoted.

Figure 7:
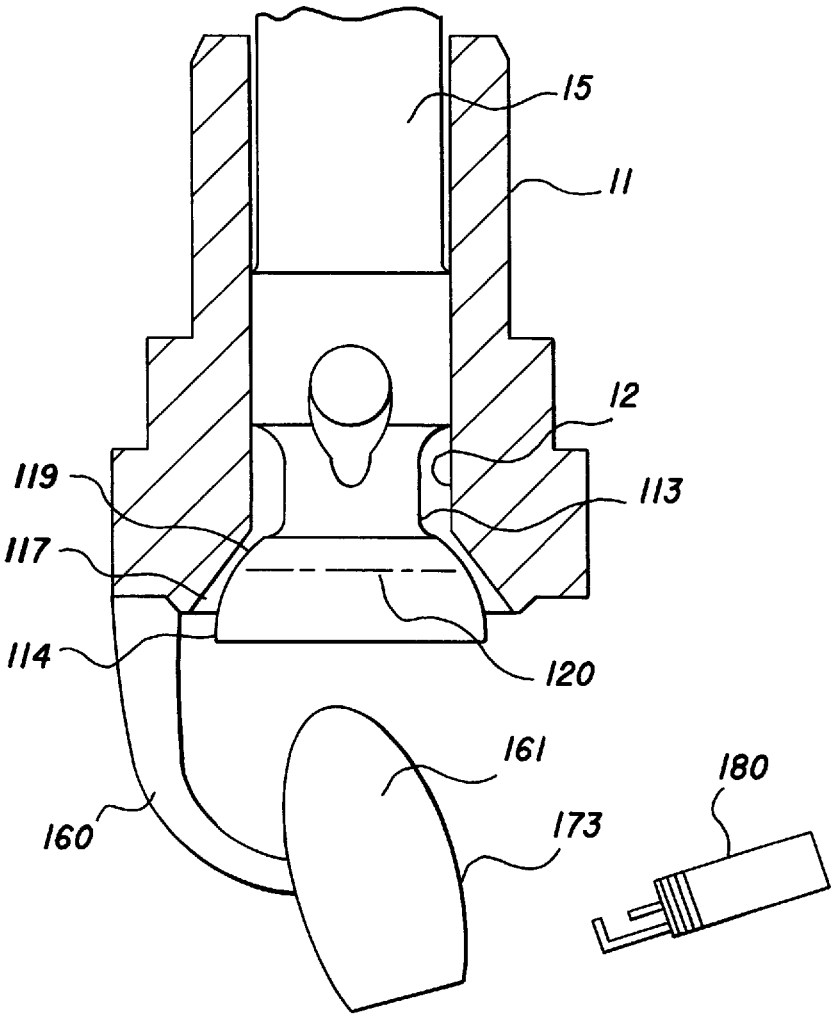
FIG. 7 is a part-sectional view of a fuel injection nozzle having a flow control body supported from the injector body thereof to direct fuel towards a spark plug.

Referring now to FIG. 7, at the downstream end of an arcuate arm 160, there is located a flow control body 161 having the axis thereof at an angle to the central axis of a valve member 113 and providing a control surface 173. In use, a plume or spray of fuel issuing from the port 117 will be guided in the direction of a spark plug 180 along the control surface 173.

It is to be understood that the flow control body 61, 161 described and as shown in FIGS. 6 or 7 may be connected either to the valve member, the nozzle body itself, the spark plug, the cylinder wall, or, indeed, any advantageous location in the cylinder head. The location is not a limitation upon the present invention. Furthermore, the flow control body 61, 161 need not be symmetrical in any particular way and may be provided with a hollow portion as referred to hereinbefore.

The present invention is applicable to poppet type fuel injector nozzles of all constructions where the fuel issues therefrom in the form of a plume including injectors where fuel alone is injected and where fuel entrained in a gas, such as air, is injected. Examples of specific nozzle constructions to which the invention can be applied are disclosed in the applicant's U.S. Pat. Nos. 5,090,625 and 5,593,095 both being incorporated herein by reference. Also, the injector nozzles as disclosed herein can be used for injecting other fluids in addition to fuel with similar beneficial control of the fluid spray. Furthermore, the injector nozzle of the invention may equally be used in valves of the pintle type.

The invention is not to be limited by the foregoing description and other variations may be developed by those skilled in the art which fall within the scope of the invention. It is to be understood that the present invention may be applied to injector nozzles supplying fuel directly into the combustion chamber or into the engine air supply system, and may be applied to both two and four stroke cycle engines. In addition, the injector nozzles may be used in applications other than the delivery of fuel to internal combustion engines.

I claim:

1. An injector nozzle comprising a control body having a nozzle through which fluid is delivered, said nozzle comprising a port having an internal surface and a valve member having a complementary external surface, said valve member being movable relative to the port to respectively provide a passage between said surfaces for the delivery of fluid in the form of a spray or sealed contact therebetween to prevent the delivery of fluid, a fluid flow control body located beyond an extremity of the body of the injector nozzle corresponding to the location of the port, said flow control body having a control surface spaced from the nozzle in the direction of movement of the valve member, said control surface being configured and positioned to promote the fluid spray established by the fluid issuing from the port to follow a path determined by the shape of said control surface, wherein the flow control body is in part hollow.

2. An injector nozzle as claimed in claim 1, wherein the flow control body is supported by a neck portion extending between the valve member and the flow control body to thereby define an annular space between the flow control body and the valve member that extends substantially to the periphery of the valve member.

3. An injector nozzle as claimed in claim 1 wherein the flow control body is supported by a member rigidly secured to a portion of the nozzle body.

4. An injector nozzle as claimed in claim 1, wherein the flow control body is positioned and configured to promote the fluid spray to contract inwardly to follow said path.

5. An injector nozzle as claimed in claim 1, wherein the control surface is assymetrical with respect to the common axis of the port and valve member.

6. An injector nozzle as claimed claim 1, wherein the control surface is symmetrical with respect to an axis inclined to the common axis of the port and valve member.

7. An injector nozzle as claimed in claim 1, wherein the flow control body is open at an end thereof furthermost from the valve member and a cavity extends from said end towards the opposite end of the flow control body.

8. An injector nozzle as claimed in claim 1, wherein the flow control body is mounted on a core member fixedly mounted on the valve member, said flow control body having limited free movement on the core in the axial direction thereof.

9. An injector nozzle as claimed in claim 1, wherein the flow control body is of substantially circular cross-section throughout the length thereof, and progressively increases in diameter from the end thereof remote from the valve member to an intermediate diametric plane and progressively decreases in diameter from said intermediate diametric plane toward the other end of the flow control body.

10. An injector nozzle as claimed in claim 9, wherein the axis of the flow control body is inclined to the axis of the valve member and port.

* * * * *

UNITED STATES PATENT AND TRADEMARK OFFICE

CERTIFICATE OF CORRECTION

PATENT NO. : 5,833,142

DATED : November 10, 1998

INVENTOR(S) : David James CALEY

It is certified that error appears in the above-identified patent and that said Letters Patent is hereby corrected as shown below:

On the cover page,

Item [30]

Change "Aug. 18, 1994" to --Aug. 18, 1993--.

Change "Aug. 31, 1994" to --Aug. 31, 1993--.

Signed and Sealed this

Twenty-ninth Day of June, 1999

*Attest:*

Q. TODD DICKINSON

*Attesting Officer*

*Acting Commissioner of Patents and Trademarks*